US010350668B2

(12) United States Patent
López Lage

(10) Patent No.: US 10,350,668 B2
(45) Date of Patent: Jul. 16, 2019

(54) HOT FORMING DIE QUENCHING

(71) Applicant: AUTOTECH ENGINEERING A.I.E., Amorebieta-Etxano (ES)

(72) Inventor: Manuel López Lage, Abrera (ES)

(73) Assignee: AUTOTECH ENGINEERING A.I.E., Amorebieta-Etxano (ES)

( * ) Notice: Subject to any disclaimer, the term of this patent is extended or adjusted under 35 U.S.C. 154(b) by 0 days.

(21) Appl. No.: 15/316,830

(22) PCT Filed: Jun. 15, 2015

(86) PCT No.: PCT/EP2015/063372

§ 371 (c)(1),
(2) Date: Dec. 6, 2016

(87) PCT Pub. No.: WO2015/193256

PCT Pub. Date: Dec. 23, 2015

(65) Prior Publication Data

US 2017/0113260 A1 Apr. 27, 2017

(30) Foreign Application Priority Data

Jun. 16, 2014 (EP) ..... 14382233

(51) Int. Cl.
*B21D 37/16* (2006.01)
*B21D 22/02* (2006.01)

(52) U.S. Cl.
CPC ..... *B21D 37/16* (2013.01); *B21D 22/022* (2013.01)

(58) Field of Classification Search
CPC ..... B21D 37/19; B21D 22/022; B21D 24/16
See application file for complete search history.

(56) References Cited

U.S. PATENT DOCUMENTS 3,584,487 A * 6/1971 Carlson ..... B21D 37/16 219/650
3,703,093 A 11/1972 Komatsu et al.
(Continued)

FOREIGN PATENT DOCUMENTS

CN 102304612 A 1/2012
CN 102873213 A 1/2013
(Continued)

OTHER PUBLICATIONS

International Search Report and Written Opinion of the International Searching Authority dated Sep. 1, 2015 for PCT/EP2015/063372, 10 pages.

*Primary Examiner* — Debra M Sullivan
(74) *Attorney, Agent, or Firm* — Squire Patton Boggs (US) LLP

(57) ABSTRACT

A tool for hot forming die quenching boron steel structural components having locally different microstructures and mechanical properties is described. The tool includes upper and lower mating dies, each die being formed by two or more die blocks including a working surface that in use faces the structural component to be formed, and side faces. The upper and lower dies include at least two neighboring die blocks adapted to operate at different temperatures corresponding to zones of the structural component to be formed having locally different microstructures and mechanical properties, wherein the neighboring die blocks are arranged with a gap between their side faces and end portions of the side faces of the neighboring die blocks that are close to the working surface are designed such that in use they are in contact.

17 Claims, 2 Drawing Sheets

(56) References Cited

U.S. PATENT DOCUMENTS

| | | | | |
|---|---|---|---|---|
| 2008/0184763 | A1* | 8/2008 | Schroth | B21D 22/205 72/342.1 |
| 2011/0030442 | A1 | 2/2011 | Lety et al. | |

FOREIGN PATENT DOCUMENTS

| | | | | |
|---|---|---|---|---|
| CN | 103233109 | A | 8/2013 | |
| CN | 103464607 | A | 12/2013 | |
| DE | 10162437 | A1 * | 7/2003 | B21D 26/031 |
| DE | 10162437 | A1 | 7/2003 | |
| DE | 102011018850 | A1 | 10/2012 | |
| FR | 2927828 | A1 | 8/2009 | |
| WO | WO 2014/091014 | A1 | 6/2014 | |

* cited by examiner

HOT FORMING DIE QUENCHING

This application claims the benefit of European Patent Application EP14382233.6 filed on Jun. 16, 2014.

The present disclosure relates to tools for hot forming (and) die quenching for manufacturing hot-formed vehicle structural components with regions of high strength and regions of increased ductility (soft zones).

BACKGROUND

The demand for weight reduction in the automotive industry has led to the development and implementation of lightweight materials, and related manufacturing processes and tools. The growing concern for occupant safety also leads to the adoption of materials which improve the integrity of the vehicle during a crash while also improving the energy absorption.

A process known as Hot Forming Die Quenching (HFDQ) uses boron steel sheets to create stamped components with Ultra High Strength Steel (UHSS) properties, with tensile strengths up to 1,500 MPa. The increase in strength allows for a thinner gauge material to be used, which results in weight savings over conventionally cold stamped mild steel components.

Typical vehicle components that may be manufactured using the HFDQ process include: door beams, bumper beams, cross/side members, A/B pillar reinforcements, and waist rail reinforcements.

Hot forming of boron steels is becoming increasingly popular in the automotive industry due to their excellent strength and formability. Many structural components that were traditionally cold formed from mild steel are thus being replaced with hot formed equivalents that offer a significant increase in strength. This allows for reductions in material thickness (and thus weight) while maintaining the same strength. However, hot formed components offer very low levels of ductility and energy absorption in the as-formed condition.

In order to improve the ductility and energy absorption in key areas of a component such as a beam, it is known to introduce softer regions within the same component. This improves ductility locally while maintaining the required high strength overall. By locally tailoring the microstructure and mechanical properties of certain structural components such that they comprise regions with very high strength (very hard) and regions with increased ductility (softer), it may be possible to improve their overall energy absorption and maintain their structural integrity during a crash situation and also reduce their overall weight. Such soft zones may also advantageously change the kinematic behavior in case of collapse of a component under an impact.

Known methods of creating regions with increased ductility (soft zones) in vehicle structural components involve the provision of tools comprising a pair of complementary upper and lower die units, each of the units having separate die elements (steel blocks). The die elements are designed to work at different temperatures, in order to have different cooling rates in different zones of the part being formed during the quenching process, and thereby resulting in different material properties in the final product (soft areas). E.g. one die element may be cooled in order to quench the corresponding area of the component being manufactured at high cooling rates and by reducing the temperature of the component rapidly. Another neighboring die element may include heating elements in order to ensure that the corresponding portion of the component being manufactured cools down at a lower cooling rate, and thus remaining at higher temperatures than the rest of the component when it leaves the die.

One problem related to this sort of manufacturing is that where the die elements working at different temperature touch each other, a large temperature differential may be present, which creates a heat flow from a warm die element to a cold die element. The warm die element thus becomes slightly colder and the cooler die element becomes slightly warmer. The result may be that a relatively wide transition zone is created between a soft zone and a hard zone of the component. The behavior and characteristics of the component may thus be less well defined.

One solution to this problem may be to physically separate and thermally insulate die elements from each other e.g. by providing an idle gap in between them and/or by providing an insulating material in the gap. Document U.S. Pat. No. 3,703,093 describe such methods and tools. Manufacturing defects e.g. wrinkles or other irregularities in the final formed component may thus appear in those areas of the product that are not properly supported by or contacted by die elements.

Other known methods create regions with increased ductility by heating with a laser. But these methods are rather slow and cumbersome as laser heating is carried out after a HFDQ process.

It is an object of the present disclosure to provide improved tools for manufacturing hot-formed vehicle structural components with regions of high strength and other regions of increased ductility (soft zones).

SUMMARY

In a first aspect, a tool for hot forming die quenching boron steel structural components having locally different microstructures and mechanical properties is provided. The tool comprises upper and lower mating dies and each die is formed by two or more die blocks comprising a working surface that in use faces the structural component to be formed and side faces. The upper and lower dies comprise at least two neighboring die blocks adapted to operate at different temperatures corresponding to zones of the structural component to be formed having locally different microstructures and mechanical properties, wherein the neighboring die blocks are arranged with a gap between their side faces and end portions of the side faces of the neighboring die blocks that are close to the working surface are designed such that in use they are in contact.

According to this aspect, the fact that the end portions of the side faces are in contact when they operate guarantees that the whole blank is in contact with a die block when it is being formed. This means that there are no unsupported portions of the blank thus avoiding or at least reducing manufacturing defects such as for example wrinkles or other irregularities in the final formed component. At the same time, the gap provided between the side faces provides thermal insulation between the die blocks thus reducing heat flow between the neighboring die blocks, i.e. a relatively narrow transition zone can be achieved thus providing a component with substantially well-defined zones, and at the same time irregularities can be avoided or at least reduced.

In some examples, the gap may be at least partially filled with an insulating material. This enhances insulating properties of the gap between neighboring die blocks adapted to operate at different temperatures, thus enhancing the technical properties of each zone of the formed component.

In some of these examples, end portions of the side faces of the neighboring die blocks, opposite to the end portions that are close to the working surface, may also be designed such that in use they are in contact. This enhances the provision of the insulating material within the gap.

In some examples, a surface of the die blocks opposite to the working surface may be supported by a cooling plate having a cooling system that may be provided in correspondence with the die blocks adapted to operate at a higher temperature. This avoids or at least reduces heating of the die support structure.

BRIEF DESCRIPTION OF THE DRAWINGS

Non-limiting examples of the present disclosure will be described in the following with reference to the appended drawings, in which.

DETAILED DESCRIPTION OF EXAMPLES

Figure 1:
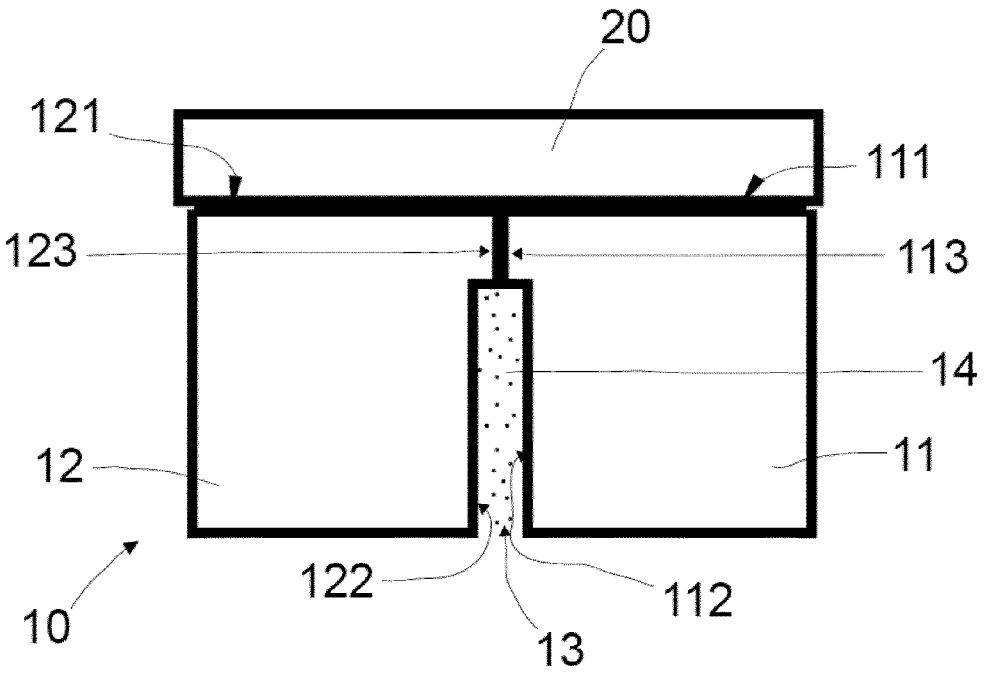
FIG. 1 shows a portion of a tool for manufacturing hot formed structural components according to an example.

FIG. 1 shows a portion of a tool for manufacturing hot formed structural components according to an example. The tool may comprise upper and lower mating dies. In FIG. 1 only a lower die 10 is shown. The lower die 10 may comprise two neighboring die blocks 11 and 12 adapted to operate at different temperatures. E.g. die block 11 may comprise a heat source in order to be adapted to achieve higher temperatures ("hot block") than die block 12 which may comprise a cooling system in order to be adapted to achieve lower temperatures ("cold block") than die block 11. In further examples, more die blocks may be provided in a single tool (and in each mating die) and other ways of adapting the blocks to operate at lower or higher temperatures may also be foreseen.

Throughout the present description and claims higher temperatures may generally be understood as temperatures falling within the range 350-550° C. and lower temperatures may be understood as temperatures falling within the range below 200° C.

In the example of FIG. 1, the die blocks 11 and 12 may each comprise a working surface 111 and 121 that in use may be in contact with a blank 20 to be formed and side faces 112 and 122. Between the side faces 112 and 122 of the neighboring blocks 11 and 12, a gap 13 may be provided and the die blocks 11 and 12 may further be designed such that end portions 113 and 123 of the side faces 112 and 122 that are close to the working surfaces 111 and 121 are in contact when they are heated. This means that when the tool is not being used and the blocks are not yet heated, a gap may also exist between the end portions 113 and 123 so as to permit expansion of the blocks when they are heated such that when heated (expanded) the end portions 113 and 123 are in contact.

In the example shown in FIG. 1, the gap 13 may be completely filled with an insulating material 14. In alternative examples, the gap may be partially filled with an insulating material (see FIG. 3) or it may even be "empty", i.e. filled with air.

In further examples, the same reference signs have been used to indicate the same parts or components.

Figure 2:
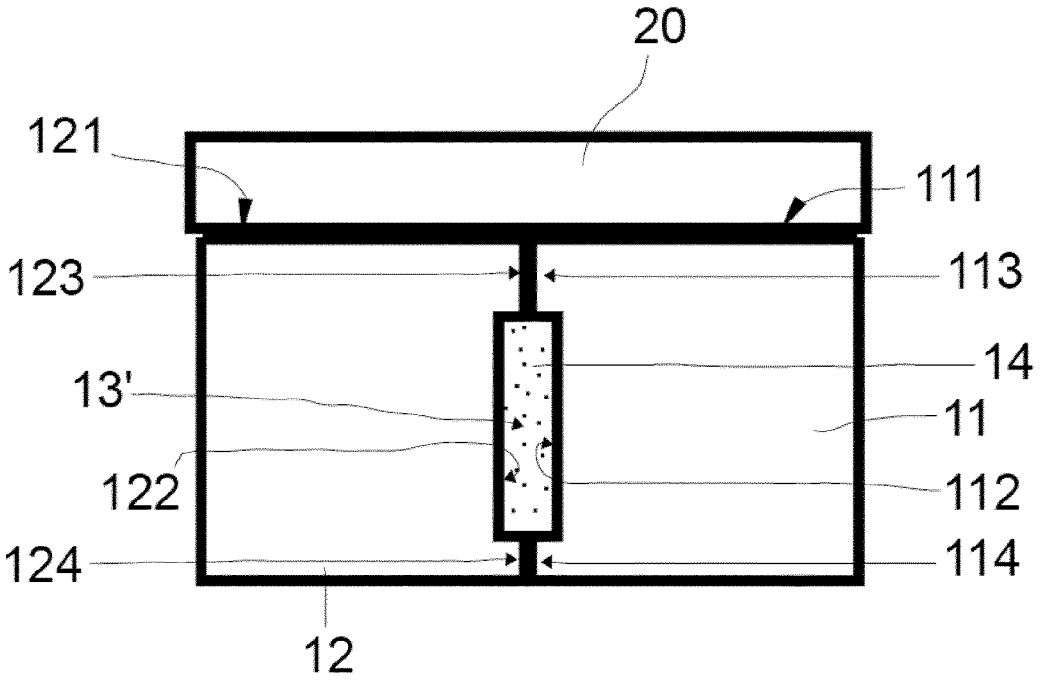
FIG. 2 shows a similar portion of a tool for manufacturing hot formed structural components according to another example.

FIG. 2 shows a portion of a tool for manufacturing hot formed structural components according to another example. The example of FIG. 2 differs from that of FIG. 1 in that end portions 114 and 124 of the side faces 112 and 122 of the neighboring blocks 11 and 12 that are opposite to the end portions 113 and 123, may also be designed such that in use they are in contact. This way, in a similar manner as explained above in connection with FIG. 1, before heating the blocks 11 and 12, a gap (not shown) may be provided between end portions 114 and 124 so as to permit expansion of the blocks 11 and 12 when they are heated. In this example, a recess 13' may be left between the side faces 112 and 122 of the neighboring die blocks 11 and 12. The recess 13' may also be completely filled with an insulating material 14 as explained in connection with FIG. 1 or it may be partially filled or even "empty", i.e. filled with air. In further examples, the recess may be formed as an opening or indentation in a side face of the blocks, i.e. the recess may not necessarily be provided over the entire length or width of a side face.

Figure 3:
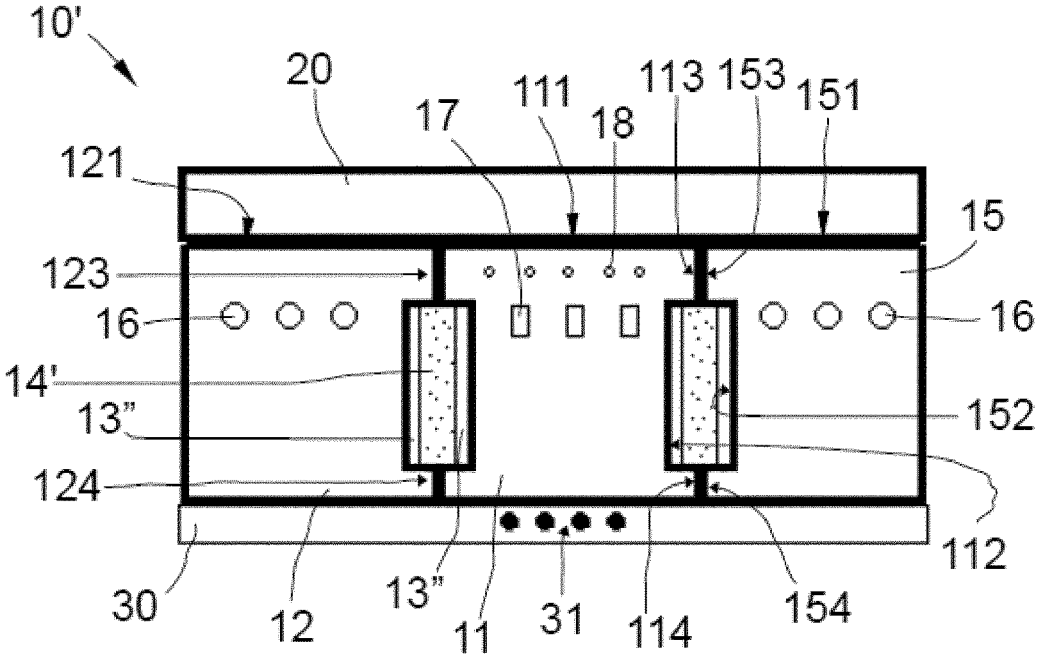
FIG. 3 shows a portion of a tool for manufacturing hot formed structural components according to yet a further example.

FIG. 3 shows a portion of a tool for manufacturing hot formed structural components according to yet a further example. The example of FIG. 3 differs from that of FIG. 2 in that three die blocks 11, 12, 15 may be provided. Blocks 12 and 15 may be adapted to operate at lower temperature ("cold blocks") and block 11 that may be arranged between blocks 12 and 15, may be adapted to operate at higher temperature ("hot block"). Die blocks 11 and 12 and die blocks 11 and 15 may be considered as neighboring blocks. Similarly to what was explained for die blocks 11 and 12 in connection with FIG. 1, die block 15 may also comprise a working surface 151 that in use may be in contact with a blank 20 to be formed and side faces 152. Between the side faces 112 and 152 of the neighboring blocks 11 and 15, a separation (gap) may also be provided and the die blocks 11 and 15 may also be designed such that end portions 113 and 153 of their side faces 112 and 152 that are close to their working surfaces 111 and 151 are in contact when they are heated.

In the example shown in FIG. 3 and similarly to what was explained for die blocks 11 and 12 in connection with FIG. 2, end portions 114 and 154 of the side faces 112 and 152 of the neighboring blocks 11 and 15 that are opposite to the end portions 113 and 153 may also be designed such that in use they are in contact.

The example shown in FIG. 3 also differs from that of FIG. 2 in that the separation provided between side surfaces 112 and 122 (or 112 and 152) of neighboring die blocks 11 and 12 (or 11 and 15) may not be fully filled with insulating material 14', but a gap 13" may be left between each side surface 112 and 122 (or 112 and 152) and the insulating material 14'. The gap 13" may actually be filled with air, which can also act as an insulator.

In FIG. 3, die blocks 12 and 15 that are adapted to operate at lower temperatures ("cold blocks") may be provided with a cooling system comprising cooling channels 16 for circulation of e.g. cold water or any other cooling fluid. Other alternatives for adapting the die blocks to operate at lower temperatures (below 200° C.) may also be foreseen.

In FIG. 3 the die block 11 that is adapted to operate at higher temperatures ("hot block") may be provided with electric heaters 17 and temperature sensors 18 to control the temperature of the die block 11. Other alternatives for adapting the die block to operate at higher temperatures (within 350-550° C.) may also be foreseen, e.g. embedded cartridge heaters. The sensors may be thermocouples.

Furthermore, the lower die 10' shown in FIG. 3 may be supported by a cooling plate 30 comprising a cooling system 31 arranged in correspondence with die block 11, i.e. the "hot block". The cooling system may comprise cooling channels for circulation of cold water or any other cooling fluid in order to avoid or at least reduce heating of the die support structure.

A formed structural end product made with a die having upper and lower dies substantially as described in connection with FIG. 3 results in a component having the zones that were formed in contact with blocks 12 and 15 ("cold blocks") having increased yield strength and the zone that was formed in contact with block 11 ("hot block") having improved energy absorption properties. Preservation of a structural integrity of the component under high dynamic loads e.g. a crash is thus achieved.

Although the example of FIG. 3 comprises a hot block 11 arranged in between two cold blocks 12, 15, other configurations may also be possible. E.g. a hot block may be surrounded by cold blocks at its four sides, considering square or rectangular blocks and it may also be arranged close to another hot block defining a bigger "hot zone". In other examples involving square and rectangular blocks, three sides may have neighboring cold blocks or even only one side, depending on the geometry and the mechanical properties of the piece to be formed.

It should be understood that although the figures describe blocks (cold and hot blocks) having a substantially square or rectangular shape, the blocks may have any other shape (see blocks E3-E8 of FIG. 4) and may even have partially rounded shapes as long as consecutive blocks have complementary sides so they can be put together as if they were pieces of a puzzle forming the upper and lower dies.

Furthermore, each upper and lower die forming a tool for manufacturing hot formed structural components may be formed by a plurality of die blocks that may be interchangeable. E.g. any zone having a cold block may be changed to a zone having a hot block and vice versa in order to change the component to be formed and/or its mechanical properties.

Figure 4:
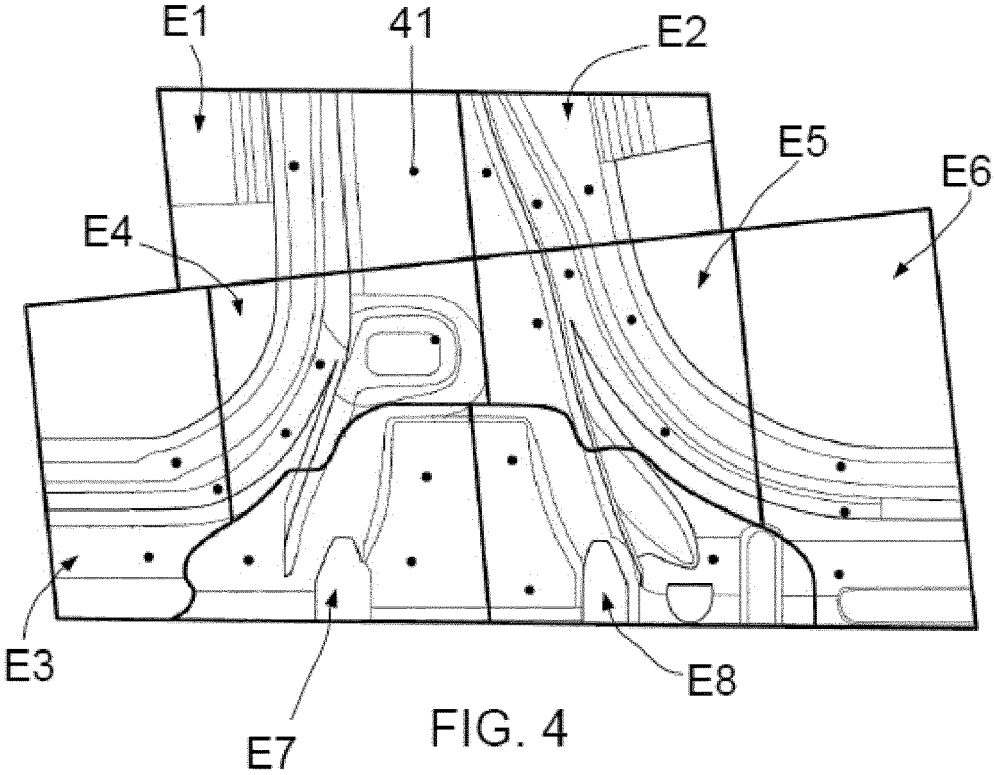
FIG. 4 shows a lower or upper die viewed from the other of the lower or upper die according to an example.

FIG. 4 shows a lower or upper die 40 viewed from the other of the lower or upper die according to an example. The example of FIG. 4 shows a die 40 for hot stamping a lower portion of a B-pillar. In this example, the die 40 may comprise eight die elements E1-E8. Each die element may comprise a plurality of thermocouples 41 (represented by black dots). The blocks involving more thermocouples may be those designed to stamp changes in the geometry of the hot formed component. In that sense, in planar geometries only one or two thermocouples may be used (see block E1) whereas more complex geometries use more thermocouples.

Each thermocouple 41 may define a zone of the tool operating at a predefined temperature. Furthermore, each thermocouple 41 may be associated with a heater or group of heaters in order to set the temperature of that zone. The total amount of power per zone (block) may limit the capacity of grouping heaters together.

The thermocouples may be associated with a control panel. Each heater or group of heaters may thus be activated independently from the other heaters or group of heaters even within the same block. Thus, using a suitable software-implemented control a user will be able to set the key parameters (power, temperature, set temperature limits, water flow on/off) of each zone within the same block.

For example, in FIG. 4, twenty four thermocouples 41 may be provided in eight blocks E1-E8 forming any of the upper or lower dies. In this case, each die may comprise twenty four zones (or thermocouples) and a complete tool (for this portion of the B-pillar) may thus involve forty eight zones. In this case, the software may control up to forty eight different (independent) zones. This allows a very precise control of the temperature in each zone within the same block, in some examples even in the order of 0.1° C.

The software may further be able to connect or at least relate different thermocouples. By doing this, if a thermocouple is not working properly, it can be linked with the closest thermocouple. This is only possible if these thermocouples work at the same or substantially similar temperature independently on whether they belong to the same block or they are provided in neighboring die blocks.

In some examples the insulating material may be a ceramic material, for example, a ceramic refractory fiber paper. In an example, the insulating material may be a composition of biodegradable high performance ceramic, inorganic fibers, fillers and organic binders such as rockwool and cellulose, silicate fillers and organic binders.

In above described examples, the upper die may have a substantially similar or even equal configuration to that shown for the lower die in order to cooperate with the lower die.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A tool for hot forming die quenching boron steel structural components having locally different microstructures and mechanical properties, the tool comprising:

upper and lower mating dies mounted on a press for stamping a structural component, each of the upper and lower mating dies comprising one or more low temperature die block(s) and one or more high temperature die block(s) comprising side faces and a working surface that in use faces the structural component to be stamped, the one or more high temperature die block(s) being adapted to operate at a temperature of 350-550 deg. C. and the one or more low temperature die block(s) being adapted to operate at a temperature less than 200 deg. C., wherein the low and high temperature die blocks correspond to zones of the structural component to be stamped having locally different microstructures and mechanical properties, at least one of the high temperature die blocks is arranged adjacent to at least one of the low temperature die blocks to form neighboring die blocks configured to operate at different temperatures, wherein the neighboring die blocks are arranged with a gap between their side faces, and wherein end portions of the side faces of the neighboring die blocks adjacent to the working surface include a gap to permit expansion of the neighboring die blocks such that the end portions of the side faces are configured to contact each other when heat is applied to the die blocks.

2. The tool of claim 1, wherein the side faces of the neighboring die blocks comprise a recess.

3. The tool of claim 1, wherein the gap between the side faces of the neighboring die blocks is at least partially filled with an insulating material.

4. The tool of claim 3, wherein the insulating material is a ceramic material.

5. The tool of claim 4, wherein the ceramic material is ceramic paper.

6. The tool of claim 3, wherein end portions of the side faces of the neighboring die blocks, opposite to the end portions adjacent to the working surface, are in contact when the working surface faces the structural component.

7. The tool of claim 1, wherein the one or more low temperature die block(s) comprises a cooling system.

8. The tool of claim 1, wherein the one or more high temperature die block(s) comprises heater(s) and sensor(s) to control a temperature of the one or more high temperature die block(s).

9. The tool of claim 8, wherein the sensor(s) are thermocouple(s) associated with one or more of the heaters.

10. The tool of claim 9, wherein the heaters associated with a single thermocouple or group of thermocouples can be activated independently.

11. The tool of claim 1, wherein a surface of the die blocks opposite to the working surface is supported by a cooling plate having a cooling system adapted to lower the temperature of the one or more high temperature die block(s).

12. A tool for hot forming die quenching boron steel structural components having locally different microstructures and mechanical properties, the tool comprising:

upper and lower mating dies mounted on a press for stamping a structural component, each of the upper and lower mating dies comprising one or more low temperature die block(s) and one or more high temperature die block(s) comprising side faces and a working surface that in use faces the structural component to be stamped, the one or more high temperature die block(s) being adapted to operate at a higher temperatures than the one or more low temperature die block(s), wherein the low and the high temperature die blocks correspond to zones of the structural component to be stamped having locally different microstructures and mechanical properties, at least one of the high temperature die blocks is arranged adjacent to at least one of the low temperature die blocks to form neighboring die blocks configured to operate at different temperatures, wherein the neighboring die blocks are arranged with a gap between their side faces, wherein end portions of the side faces of the neighboring die blocks adjacent to the working surface include a gap to permit expansion of the neighboring die blocks such that the end portions of side faces are configured to contact each other when heat is applied to the die blocks, wherein end portions of the side faces of the neighboring die blocks, opposite to the end portions adjacent to the working surface, are in contact when the working surface faces the structural component, and wherein the gap between the side faces of the neighboring die blocks is at least partially filled with a ceramic insulating material.

13. The tool of claim 12, wherein the ceramic material is ceramic paper.

14. The tool of claim 12, wherein a surface of the die blocks opposite to the working surface is supported by a cooling plate having a cooling system adapted to lower the temperature of the one or more high temperature die block(s).

15. The tool system of claim 12, wherein the gap between the side faces of the neighboring die blocks is completely filled with the ceramic insulating material.

16. A tool for hot forming die quenching boron steel structural components having locally different microstructures and mechanical properties, the tool comprising:

upper and lower mating dies mounted on a press for stamping a structural component, each of the upper and lower mating dies comprising one or more low temperature die block(s) and one ore more high temperature die block(s) comprising side faces and a working surface that in use faces the structural component to be stamped, the one or more high temperature die block(s) being adapted to operate at higher temperatures than the one or more low temperature die block(s), wherein the low and high temperature die blocks correspond to zones of the structural component to be stamped having locally different microstructures and mechanical properties, at least one of the high temperature die blocks is arranged adjacent to at least one of the low temperature die blocks to form neighboring die blocks configured to operate at different temperatures, wherein the neighboring die blocks are arranged with a gap between their side faces, wherein end portions of the side faces of the neighboring die blocks adjacent to the working surface include a gap to permit expansion of the neighboring die blocks such that the end portions of side faces are configured to contact each other when heat is applied to the die blocks, wherein end portions of the side faces of the neighboring die blocks, opposite to the end portions adjacent to the working surface, are in contact when the working surface faces the structural component, and wherein the one or more low temperature die block(s) comprise a cooling system and the one or more high temperature die block(s) comprise heater(s) and sensor(s) to control a temperature of the one or more high temperature die block(s).

17. The tool of claim 16, wherein a surface of the die blocks opposite to the working surface is supported by a cooling plate having a cooling system adapted to lower the temperature of the one or more high temperature die block(s).

* * * * *